US007287899B2

(12) United States Patent
Navarro et al.

(10) Patent No.: US 7,287,899 B2
(45) Date of Patent: Oct. 30, 2007

(54) METHOD FOR CONTINUOUSLY AND DYNAMICALLY MIXING AT LEAST TWO FLUIDS, AND MICROMIXER

(75) Inventors: Christophe Navarro, Bidache (FR); Peter Walzel, Dormagen-Allemagne (FR)

(73) Assignee: Arkema France, Colombes, Cedex (FR)

( * ) Notice: Subject to any disclaimer, the term of this patent is extended or adjusted under 35 U.S.C. 154(b) by 312 days.

(21) Appl. No.: 10/517,190

(22) PCT Filed: May 23, 2003

(86) PCT No.: PCT/FR03/01570

§ 371 (c)(1),
(2), (4) Date: Dec. 7, 2004

(87) PCT Pub. No.: WO03/103818

PCT Pub. Date: Dec. 18, 2003

(65) Prior Publication Data

US 2005/0237854 A1 Oct. 27, 2005

(30) Foreign Application Priority Data

Jun. 7, 2002 (FR) ..... 02 07025

(51) Int. Cl.
*B01F 7/02* (2006.01)

(52) U.S. Cl. ..... 366/341; 366/343; 366/DIG. 1; 366/DIG. 2; 366/DIG. 3; 366/DIG. 4

(58) Field of Classification Search ..... 366/337, 366/339, 340, 343, 167.1, 173.2, 181.6, 341, 366/DIG. 1, DIG. 2, DIG. 3, DIG. 4
See application file for complete search history.

(56) References Cited

U.S. PATENT DOCUMENTS

| | | | | |
|---|---|---|---|---|
| 4,805,154 | A * | 2/1989 | Schneider | 366/303 |
| 4,976,547 | A | 12/1990 | Hisanaga et al. | |
| 5,145,255 | A | 9/1992 | Shimada | |
| 5,637,639 | A | 6/1997 | Duan | |
| 5,886,112 | A | 3/1999 | Vuillemin | |
| 6,241,852 | B1 * | 6/2001 | Ekholm et al. | 162/57 |

* cited by examiner

*Primary Examiner*—Robert D. Harlan
(74) *Attorney, Agent, or Firm*—Millen, White, Zelano & Branigan, P.C.

(57) ABSTRACT

The invention relates to a method for continuously and dynamically mixing at least two fluids. Said method comprises the following steps: a) the rotor (1) of a micromixer is rotatably driven, said micromixer comprising a rotor (1) which is provided with a shaft (2) encompassing blades (3) that are arranged in groups (3*a*-3*g*), a stator (4) which is provided with at least one inlet (5) for a first fluid, at least one inlet (6) for a second fluid, and an outlet (7); b) the fluids are fed into the micromixer; and c) a micromixture of the fluids is collected at the outlet (7) of the micromixer. The inventive method is particularly suitable for rapid and/or complex kinetic chemical reactions such as anionic polymerization. The invention also relates to a micromixer for carrying out said method.

31 Claims, 8 Drawing Sheets

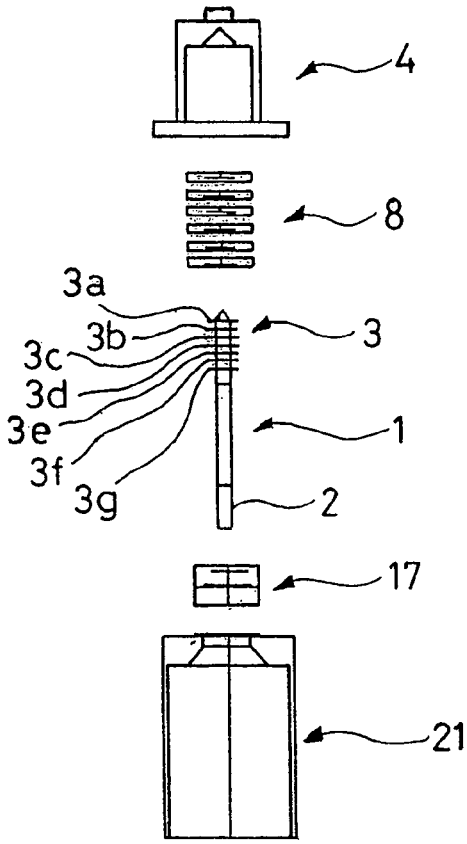
FIG_1
FIG_2
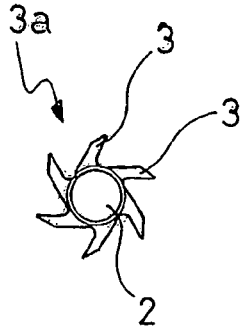
FIG_3
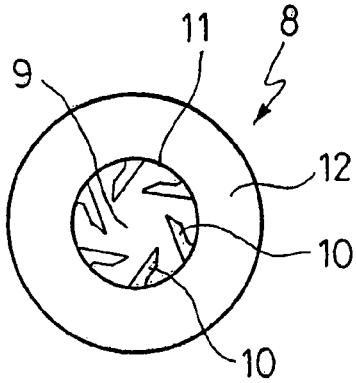
FIG_4
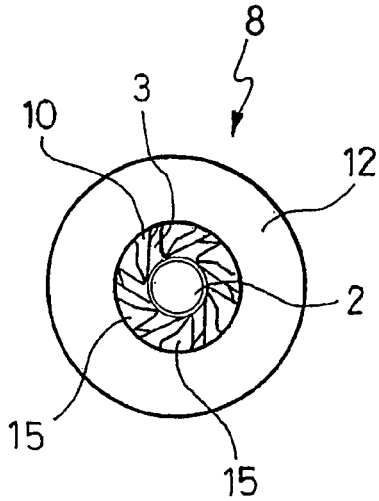

METHOD FOR CONTINUOUSLY AND DYNAMICALLY MIXING AT LEAST TWO FLUIDS, AND MICROMIXER

The present invention relates to a method for continuously and dynamically mixing at least two fluids. This method is particularly suitable for rapid and/or complex kinetic chemical reactions such as anionic polymerizations.

The invention also relates to a micromixer which is able to implement this method.

Currently, one of the most commonly used techniques for mixing two or more liquids consists of using a closed, semi-closed or open vessel, equipped with a mechanical stirrer of propeller, turbine or similar type, and injecting one or more of the reagents into the vessel.

The mixing can be carried out due to the energy dissipated by the mechanical stirring. Unfortunately, in certain cases, these devices do not allow micromixing times to be achieved which are sufficiently short for rapid and complex reactions to be implemented, and above all, they are unsuitable in the case of polymerization reactions where the viscosity increases rapidly over time.

The static mixers, placed in line in a conduit or at the inlet of a reactor, allow a good mixing of the liquids. Nevertheless, they are, most of the time, used as premixers before entering into a reactor or when the constraints of time or viscosity are not redhibitory. These devices are good for homogenizing solutions, but are not really suitable for certain polymerization reactions, in particular rapid reactions, because the risks of blocking up are significant. This is the case, in particular, for polymerizations with high levels of solid.

The tangential jet mixers (which can be used in particular for anionic polymerizations as described in EP-A-0749987) or RIM ("Reaction Injection Molding") mixing heads are confined jet mixers, i.e. with jets in contact with the wall of the mixer. They are very efficient, but cause blockages when high polymer contents are involved, or require the injection of products by pumps which are resistant to high pressures (several hundreds of bars). Moreover the RIM mixing heads require discontinuous operation.

The mixer by impact of free jets (i.e. without the jets being in contact with the walls of the mixer) is known and has been described for creating emulsions or in liquid-liquid extraction methods, for example by Abraham TAMIR, "Impinging-Stream Reactors. Fundamentals and Applications", Chap. 12: Liquid-Liquid Methods, Elsevier (1994).

Devices with free jet impact have also been described for precipitation or polymerization. They are constituted by two jets orientated according to a given angle and the impact of which causes a rapid micromixing; cf. Amarjit J., Mahajan and Donald J. Kirwan "Micromixing Effects in a Two Impinging-Jets Precipitator", Aiche Journal, Vol. 42, no. 7, pages 1801-1814(July 1996); Tadashi Yamaguchi, Masayuki Nozawa, Narito Ishiga and Akihiko Egastira "A Novel Polymerisation Method by Means of Impinging Jets", Die Angewandte Makromolekulare Chemie 85 (1980) 197-199 (no. 1311). The drawback of these systems is that they only allow the mixing of two fluids and that the jets are all of the same diameter and, consequently, if the mixture is to be effective, the respective flow rates in each jet must be the same. In the case of a polymerization reaction, the monomer arriving in a first jet and the initiator solution in a second jet with the same flow rate as the first, it is thus seen that the quantity of solvent in the system is necessarily relatively large, which means that recycling operations, which are generally costly, have to be envisaged downstream of the polymerization method.

Then a method was developed which is described in the French patent application published under the no. 2 770 151 for continuously mixing by free jet impact at least 2 fluids and recovering the mixture in the form of a resulting jet, so as to overcome the limitations which have just been described.

However, the drawback of this system is that it requires a very precise adjustment of the injection device in order that the jets of fluids correctly come into contact at a given point.

In the international patent application published under the no. WO 97/10273 a device is described for dispersing isocyanate-terminated polyurethane prepolymers comprising a dynamic mixer allowing an average residence time of 10 to 120 seconds to be achieved. However, this type of mixer is not suitable for the more rapid reactions whose average residence time in the mixer must be much shorter, in order to allow a mixing of the reagents in a sufficiently short time compared to the reaction half-life. As when the reaction and mixing rates are of the same order of magnitude, strong competition arises between these two methods. Thus, as this international application shows, a slow reaction does not require a very rapid mixing method, while the development of a rapid reaction is greatly disturbed by a slow mixing.

The object of the European patent application published under the no. EP 824 106 is a method for the preparation of cellulose particles which have cationic and/or anionic groups, in which a dynamic mixer is used comprising a stator and a rotor equipped with blades of cylindrical shape. The drawback of such a mixer is that the aggregates of matter are subjected to multiple velocity gradients which stretch and contract them in a random way, causing very significant concentration gradients.

The present invention thus aims to propose a method and a mixer for dynamically and continuously mixing at least two fluids.

It advantageously applies to the mixing of reactive fluids and in particular, to the anionic polymerization of at least one (meth)acrylic monomer.

Thus, the subject of the invention is a method comprising the following steps:

a) driving in rotation the rotor of a micromixer comprising:
   - a rotor comprising a shaft equipped with blades distributed in groups, the blades of each group being arranged around the shaft in the same plane perpendicular to the longitudinal axis of the shaft, and the groups of blades being spaced out from each other along the longitudinal axis of the shaft;
   - a stator in the form of a hollow cylinder which is able to receive the rotor, this stator comprising, at one end of its longitudinal axis, at least one inlet for a first fluid, at least one inlet for a second fluid and, at the other end of its longitudinal axis, an outlet for the micromixture of the fluids;

b) introducing the fluids into the micromixer; and c) recovering at the outlet of the micromixer a micromixture of the fluids.

A subject of the invention is also a micromixer comprising:

- a rotor comprising a shaft equipped with blades distributed in groups, the blades of each group being arranged around the shaft in the same plane perpendicular to the longitudinal axis of the shaft, and the groups of blades being spaced out from each other along the longitudinal axis of the shaft; and a stator in the form of a hollow cylinder which is able to receive the rotor, this stator comprising, at one end of its longitudinal axis, at least one inlet for a first fluid, at least one inlet for a second fluid and, at the other end of its longitudinal axis, an outlet for the micromixture of the fluids.

Such a micromixer has the double advantage of not inducing a large pressure loss and being able to be easily adjusted so as to adapt to changes in the operating conditions such as the flow rates and viscosities. In fact it only requires changing the speed of rotation of the rotor, the shape of the blades or counter-blades, or their number.

Moreover, the effectiveness of the mixing does not diminish along the longitudinal axis of the rotor as is the case in a standard mixer in the shape of a tube.

Moreover, the micromixer according to the invention is very effective even when the viscosities are high.

According to another aspect of the invention, a polymerization method is proposed, in which the method of dynamically and continuously mixing and the micromixer according to the invention are used.

This method comprises the following steps:

(i) driving in rotation the rotor of a micromixer comprising:

a rotor comprising a shaft equipped with blades distributed in groups, the blades of each group being arranged around the shaft in the same plane perpendicular to the longitudinal axis of the shaft, and the groups of blades being spaced out from each other along the longitudinal axis of the shaft;

a stator in the form of a hollow cylinder which is able to receive the rotor, this stator comprising, at one end of its longitudinal axis, at least one inlet for a first fluid, at least one inlet for a second fluid and, at the other end of its longitudinal axis, an outlet for the micromixture of the fluids;

(ii) introduction of at least two fluids, at least one of which is reactive, into the micromixer;

(iii) recovery at the outlet of the micromixer of a micromixture of the fluids;

(iv) polymerization of the reactive fluid or fluids, this polymerization being able to occur outside the micromixer or begin inside this micromixer and continue outside this micromixer.

BRIEF DESCRIPTION OF THE DRAWINGS

Other characteristics and advantages of the invention will now be described in detail in the following description which refers to the figures, in which:

FIG. 1 represents schematically and in an exploded front view, a micromixer according to the invention;

FIG. 2 represents schematically and in a top view, a rotor of the micromixer of FIG. 1;

FIG. 3 represents schematically and in a top view, a disk of the stator of the micromixer of FIG. 1;

FIG. 4 represents schematically and in a top view, the assembly of the disk of FIG. 3 and of the rotor of FIG. 2;

DETAILED DESCRIPTION OF THE INVENTION

Mixing Method According to the Invention

Figure 5:
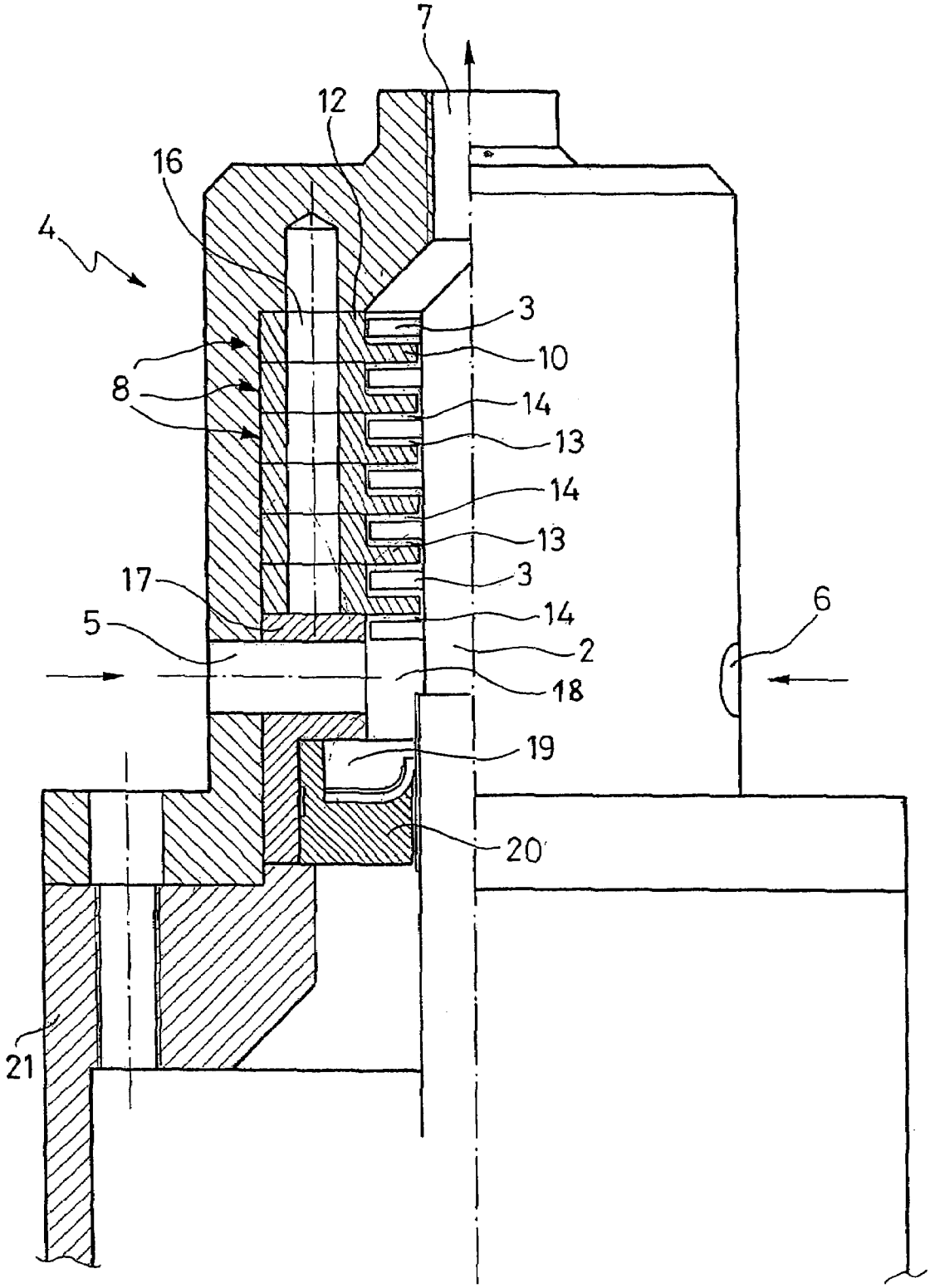
FIG. 5 represents schematically and in partial section, a micromixer according to the invention.

The method for dynamically and continuously mixing according to the invention has been described in a general way above.

It can be implemented for mixing more than two fluids. However, for the sake of simplicity, it will now be described for an implementation with two fluids.

According to the invention, the rotor can be driven in rotation at a speed which can reach up to 30,000 r.p.m.

Preferably, a speed of rotation of the rotor greater than 5,000 r.p.m is chosen, in order to obtain a homogeneous mixing and less than 20,000 r.p.m, so as to limit overheating phenomena.

The introduction of the first and second fluids preferably occurs in at least two places which are diametrically opposed with respect to the axis of the rotor of the micromixer.

The method according to the invention is generally used with a fluid temperature comprised between −100° C. and 300° C. It is preferably used with temperatures comprised between −80° C. and 110° C.

It can be implemented with fluid pressures comprised between 0.1 and 100 bars absolute. Preferably, it is used with pressures comprised between 1 and 50 bars absolute.

The fluids can be introduced into the mixer at a flow rate between 1 g/h and 10,000 kg/h. Preferably, the flow rate of the fluids is comprised between 1 kg/h and 5,000 kg/h.

The ratio of the mass flow rates of the fluids can be very variable. It is generally comprised between 0.01 and 100, preferably between 0.1 and 10.

The method according to the invention can allow mixing of fluids whose viscosity is comprised between 1 mpa.s and $10^3$ Pa.s. Preferably, this viscosity is comprised between 10 mPa.s and 10 Pa.s.

The method according to the invention is used with residence times for the fluids in the micromixer generally greater than 1 ms. Preferably, the operating conditions are adjusted so that the residence time is comprised between 5 ms and 10 s.

Polymerization Method According to the Invention

The mixing method which has just been described is particularly suitable for the micromixing of reactive fluids. It preferably applies to reactive liquids.

It can thus advantageously be implemented for the production of an intimate mixture of liquids which is to produce chemical reactions with rapid and/or complex kinetics, such as anionic polymerizations, or polymerizations with high levels of solid.

Thus, the mixing method according to the invention can constitute a part of a more global polymerization method.

This polymerization method according to the invention in particular applies to the mixture of reactive fluids intended for anionic polymerization, at least one of which comprises at least one (meth)acrylic monomer.

As (meth)acrylic monomer, there can thus be mentioned in particular acrylic anhydride, methacrylic anhydride, methyl, ethyl, propyl, n- and tert-butyl acrylates, ethylhexyl, nonyl, 2-dimethyl amino ethyl and methyl, ethyl, propyl and n- and tert-butyl methacrylates, ethylhexyl, nonyl and 2-dimethyl amino ethyl.

The actual polymerization can occur outside the micromixer according to the invention, or it can begin inside the micromixer and continue outside this micromixer, for example in an appropriate reactor.

The method according to the invention can be used in any polymerization installation. In particular the one illustrated by FIG. 1 on page 14 of the aforementioned patent application EP 749 987 can be mentioned.

The method according to the invention can in particular be used for the preparation of polymers according to the methods described in European patent applications published under the numbers EP 749 987, EP 722 958 and EP 524 054.

Micromixer According to the Invention

The micromixer according to the invention is able to implement the method which has just been described.

This micromixer has been described in a general way above.

For more details about its structure reference can be made to FIGS. 1 to 6 which give an illustration of the structure of this micromixer.

In FIG. 1 in particular, it is seen that the micromixer according to the invention comprises a rotor 1 comprising a shaft 2 of approximately cylindrical shape equipped with blades 3.

These blades 3 are distributed in groups 3*a*, 3*b*, 3*c*, 3*d*, 3*e*, 3*f* and 3*g*, the blades of each group are arranged around the shaft 2, in the same plane perpendicular to the longitudinal axis of the shaft 2, and the groups of blades being spaced out from each other along the longitudinal axis of the shaft 2. This can be seen clearly in FIG. 1, where each group 3*a* to 3*g* has the appearance of a disk.

In FIG. 2, a top view of the rotor is shown. Thus a group 3*a* of six blades 3 is seen. The blades are arranged regularly around the shaft, in a star and each is inclined at 60 degrees with respect to its two nearest neighbours.

The blades are approximately identical to each other and are in the form of a cutting edge. One of their longitudinal sides forms a tangent at the circumference of the shaft 2. The free end of each blade 3 can be tapered.

A 60 degree rotation of the shaft allows one blade to occupy the place that one of its two neighbours occupied before this rotation.

The blades 3 of a group of blades 3*a* are preferably aligned respectively with the blades of another group of blades 3*b* along the longitudinal axis of the rotor, so that in a top view and looking in the direction of the longitudinal axis of the rotor 1 (FIG. 2), only one group of blades can be seen, the others being hidden beneath them.

The rotor 1 is intended to cooperate with a stator 4 which is seen firstly in FIG. 1. This stator 4 has approximately the form of a hollow cylinder. It has dimensions which make it able to house at least partly the rotor 1.

As is seen in FIG. 5, the stator 4 comprises at one end of its longitudinal axis, an inlet 5 for a first fluid, an inlet 6 for a second fluid and at the other end of its longitudinal axis, an outlet 7 for the micromixture of fluids.

Preferably, the inlet 6 is diametrically opposed with respect to the inlet 5.

According to one embodiment of the invention, the stator 4 comprises disks 8 which are seen out of the stator in FIG. 1.

When the stator 4 is mounted, as is seen in FIG. 5, the disks 8 are stacked inside.

The specific shape of the disks 8 can be seen in FIG. 3. Each disk 8 has in its centre a recess 9 which allows it to house a group of blades 3*a* or 3*b* to 3*g*, while allowing the latter to turn together with the rotor 1.

The recess 9 has the shape of a circular hole, one part of which is occupied by extensions 10 of the disk 8. These extensions 10 project with respect to the wall 11 of the disk 8 delimiting the recess 9.

These extensions 10 of the disks 8 have approximately the same shape and the same dimensions as the blades 3 of the rotor 1. That is why in the remainder of the present description they are called counter-blades 10.

Each disk 8 thus comprises its group of six counter-blades 10 arranged in a regular manner on the circumference of the wall 11. Each counter-blade is inclined at 60 degrees with respect to its two nearest neighbours.

As for the blades 3 of the rotor 1, a 60 degree rotation of a disk 8 allows a counter-blade 10 to occupy the place that one of its two neighbours occupied before this rotation.

The counter-blades 10 of a group of counter-blades 10 are also preferably aligned respectively with the counter-blades of another group of counter-blades 10 along the longitudinal axis of the stator, so that in a top view and looking in the direction of the longitudinal axis of the stator 4 (FIG. 3), only one group of counter-blades 10 can be seen, the others being hidden beneath them.

FIG. 4 shows, in a top view, a group of blades 3 of the rotor 1 around which a disk 8 has been placed.

With reference to FIG. 5, it is noted that the counter-blades 10 have a thickness less than that of the body 12 of the disk 8 which they extend.

The disks 8 are in contact with each other, stacked inside the stator 4, so that each group of blades 3 (with the exception of the first and the last) is inserted between two groups of counter-blades 10.

Thus, when the shaft 2 of the rotor 1 turns, each group of blades 3 can turn freely, i.e. without being impeded by the adjacent groups of counter-blades 10. The blades 3 and the counter-blades 10 are preferably inclined in opposite directions so that, during rotation of the rotor, they come close to each other like the blades of shears, and thus cause shearing of the fluids.

Moreover, looking from the inlet 5 of the micromixer towards its outlet 7, it is noted that a space 13 is provided, in longitudinal direction, between each group of blades 3 and the group of counter-blades 10 which precedes it (except in the case of the first group of blades situated close to the inlet of the stator) and another space 14 is also provided between each group of blades 3 and the group of counter-blades 10 which follows it (except in the case of the last group of blades situated close to the outlet of the stator).

Moreover, as is seen in FIG. 4, when the rotor/stator assembly is seen in cross section, it is noted that the sum of the surface areas of the shaft 2, the blades 3 and the counter-blades 10 is less than the surface area of the circular hole delimited by the wall 11 of the disk 8, so that there are still spaces 15 allowing the circulation in the longitudinal direction of the fluids being mixed.

The spaces 15 have a minimum size in the case of FIG. 4, where the side of each blade 3 which is tangential to the shaft 2 is arranged parallel to the longitudinal sides of a counter-blade 10.

The spaces 15 have a maximum size when, looking in the direction of the axis of the shaft 2, the blades 3 are superposed on the counter-blades 10 and hide them.

As can be deduced from FIG. 5, a bore 16 can be provided through the thicknesses of the disks 8 and in the stator 4, in order to be able to introduce a rod or a screw (not represented) in order to immobilize the disks 8 and make them integral with the stator 4.

Generally, the stator 4 also comprises a fluid distributor 17 approximately in the form of a washer and situated at the level of the feed of the stator 4 and upstream of the disks 8, if referring to the general direction of circulation of the fluids.

One end of the distributor 17 is in annular contact with the first disk 8.

The distributor 17 comprises at least one opening for the first fluid and at least one other opening for the second fluid, these openings being cut in the washer radially and communicating respectively with the entries 5 and 6 of the stator 4.

Thus, the fluids entering through the entries 5 and 6 are taken through the openings of the distributor 17 close to the shaft 2 of the rotor 1.

Generally, the central hole 18 of the distributor 17 has a diameter approximately the same as that of the circular hole of a disk 18 delimited by the wall 11 of this disk. It follows that when the rotor 1 is mounted in the stator 4, a first group of blades 3 of the rotor 1 can optionally be inserted inside the central hole 18 and turn freely therein.

At its lower end, i.e. the one opposite the one which is in contact with a disk 18, the distributor 17 optionally has a bore 19 intended to receive a ring seal 20 which is also in contact with the shaft 2 of the rotor 1.

The stator 4 is generally-fixed onto a support 21 in a standard way using a bolt (not represented).

Operation of the Micromixer

The rotor 1 is generally driven in rotation in a standard way by means for driving in rotation such as an electric motor (not represented). However, a motor capable of maintaining a constant speed of rotation, independent of the resisting torque to which it can be subjected, (e.g. milling machine motor), is preferably chosen.

The direction of rotation of the rotor is that of the inclination of the blades 3.

As is seen by observing FIG. 5, the micromixer is fed through the inlet 5 using a first fluid and through the inlet 6 using a second fluid.

The openings of the distributor 17 take the fluids towards the centre, into the central hole 18. The fluids are then confined between the shaft 2 and the walls of the central hole 18 and are in contact with a first group of blades 3.

Under the effect of the pressure of the fluids and of the rotation of the shaft 2, the first blades, in cooperation with the first counter-blades, shear the fluids which progress through the spaces 14, then 15 and 13.

The fluids then rapidly encounter other blades 3 and counter-blades 10 until outlet 7 of the mixer where they are intimately mixed.

The intimate mixture of the fluids can then be used in numerous applications.

For example, it can be introduced into a tubular reactor or similar, and chemical reactions can occur, as described previously.

EXAMPLES

The following examples illustrate the present invention without however limiting its scope.

In these examples, the polymerization installation used is the one represented schematically in FIG. 1, page 14 of the aforementioned European patent application no. EP 749 987 and in which, as mixer M, a micromixer according to the invention is used having the following characteristics:

- internal volume of the micromixer: 1.62 ml
- diameter of the rotor shaft in the mixing zone: 5.4 mm
- thickness of the blades of the rotor: 1 mm
- thickness of the counter-blades of the disks: 1 mm
- space, measured in the direction of the longitudinal axis of the rotor, between a counter-blade of the rotor and each of the adjacent rotor blades: 0.4 mm (thickness of the disks of the stator: 2.8 mm)
- number of groups of blades: 7
- number of disks: 6

The triblocks (triblock copolymers) ABC 100, ABC 101 and ABC 104 as identified in Examples 1 to 6 are prepared according to the operating method described in the European patent application published under the number EP 524 054 or in the aforementioned application EP 749 987.

The following abbreviations were used:

PS: polystyrene

BP: polybutadiene

PMMA: poly(methylmethacrylate)

SB: diblock(diblock copolymer)poly(styrene-b-butadiene)

SBM: triblock (triblock terpolymer formed by a polystyrene block, a polybutadiene block and a poly(methyl methacrylate) block ABC 100: PS-b-PB-b-PMMA (terpolymer formed by a polystyrene block, a polybutadiene block and a poly (methyl methacrylate) block, with a mass composition (32/35/33) and having an average molecular mass by numbers of the polystyrene block, $M_n$ (PS), of 27,000 g/mol ABC 101: PS-b-PB-b-PMMA with a mass composition (20/30/50) and having an average molecular mass by numbers Mn (PS) of 20,000 g/mol ABC 104: PS-b-PB-b-PMMA with a mass composition (20/30/50) and having an average molecular mass by numbers $M_n$ (PS) of 20,000 g/mol Q(SB): flow rate in kg/h of the poly(styrene-b-butadiene)-butadienyl lithium solution, at the inlet of the micromixer, Q(M): flow rate of the methyl methacrylate solution at the inlet of the micromixer in kg/h V0: 0 r.p.m.

V1: approximately 7,600 r.p.m.

V2: approximately 11,200 r.p.m.

V3: approximately 15,000 r.p.m.

V4: approximately 18,500 r.p.m.

114T: example according to the prior art, in which the standard tangential jet mixer as described in EP 749 987 is used Ve: elution volume The average molecular mass in numbers of the PS block was determined by steric exclusion chromatography (SEC) in polystyrene equivalent, after sampling this block during the experiment.

The mass fractions of PS, PB and PMMA were determined by proton NMR.

The products contain a homopolystyrene (PS) fraction and a diblock copolymer fraction poly(styrene-b-butadiene) (SB), these fractions resulting from a non-quantitative blocking efficiency under the synthesis conditions used.

In all cases, the glass transition temperature (Tg) of the PB block is approximately −90° C.

The PMMA blocks are syndiotactic at more than 70% and have a $T_g$ of 135° C.

In Examples no. 1 to 6, the results of SEC are superposed in order for the tests carried out to be better visualized.

Example 1

The influence of the speed of rotation of the rotor of the micromixer according to the invention on the quality of an synthesized ABC 100 triblock is studied.

For this purpose, at one inlet of the micromixer, a solution of poly(styrene-b-butadiene)-butadienyl lithium and at the diametrically opposed inlet of the micromixer, a solution of methyl methacrylate is introduced.

The flow rates are kept constant, namely, 40 kg/h for Q(SB) and 20 kg/h for Q(M).

After polymerization in the tubular reactor, measurement by SEC is carried out of the intensity of the I(RD) detection as a function of the elution volume Ve.

Figure 6:
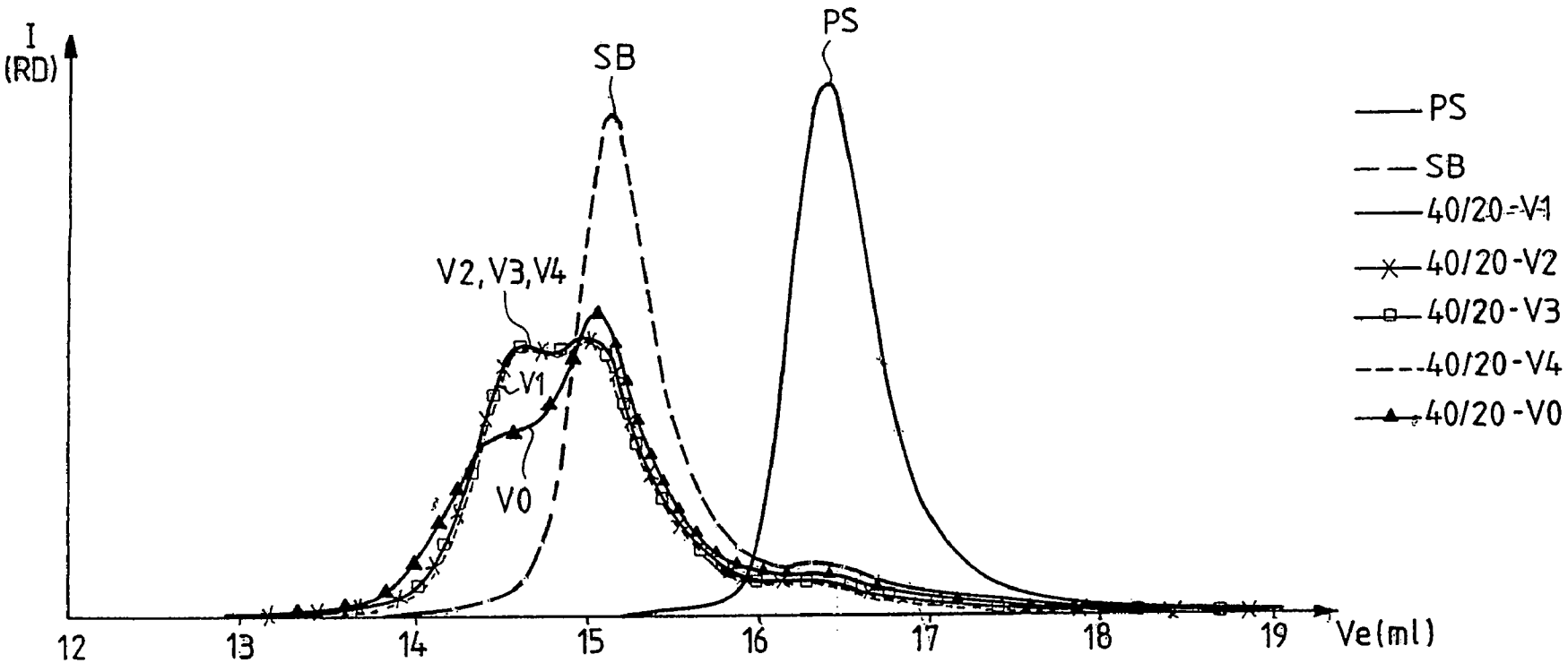
FIGS. 6 and 7 are curves showing the influence of the speed of rotation of the rotor of the micromixer according to the invention, on the quality of product obtained, at constant flow rates.

The results are shown in the form of curves in FIG. 6, each curve corresponding to a speed of rotation of the rotor.

No notable difference is observed between the synthesized ABC 100 when passing from V1 to V4.

In all cases, the presence of residual SB in the product obtained is noted.

But the proportion of SB in the synthesized ABC 100 is significantly higher at V0 than for V1, V2, V3, or V4.

This can be explained by the fact that when chemical reactions are in play, it is the bringing into contact of the reagents, the mixing on the molecular level which is important. However, the polmerization kinetics of methacrylates under these conditions is extremely rapid. Moreover, it is known that the efficiency of mixing required for a reactor depends on the relationship between the characteristic time of the reaction considered and the mixing time on the molecular level.

In the case of mixing at V0, the volume energy dissipated in the micromixing zone is smaller, which results in the contact between the reagents being less intimate.

A heterogeneous distribution of the reagents results which causes unwanted reaction terminations.

In other words, the peaks are narrower for V1 to V4, which shows that the dynamic micromixer according to the invention is more effective at a speed greater than V0.

Example 2

The influence of the speed of rotation of the rotor of the micromixer according to the invention on the quality of a synthesized ABC 101 triblock is studied.

For this purpose, the operation is carried out as in Example 1.

Figure 7:
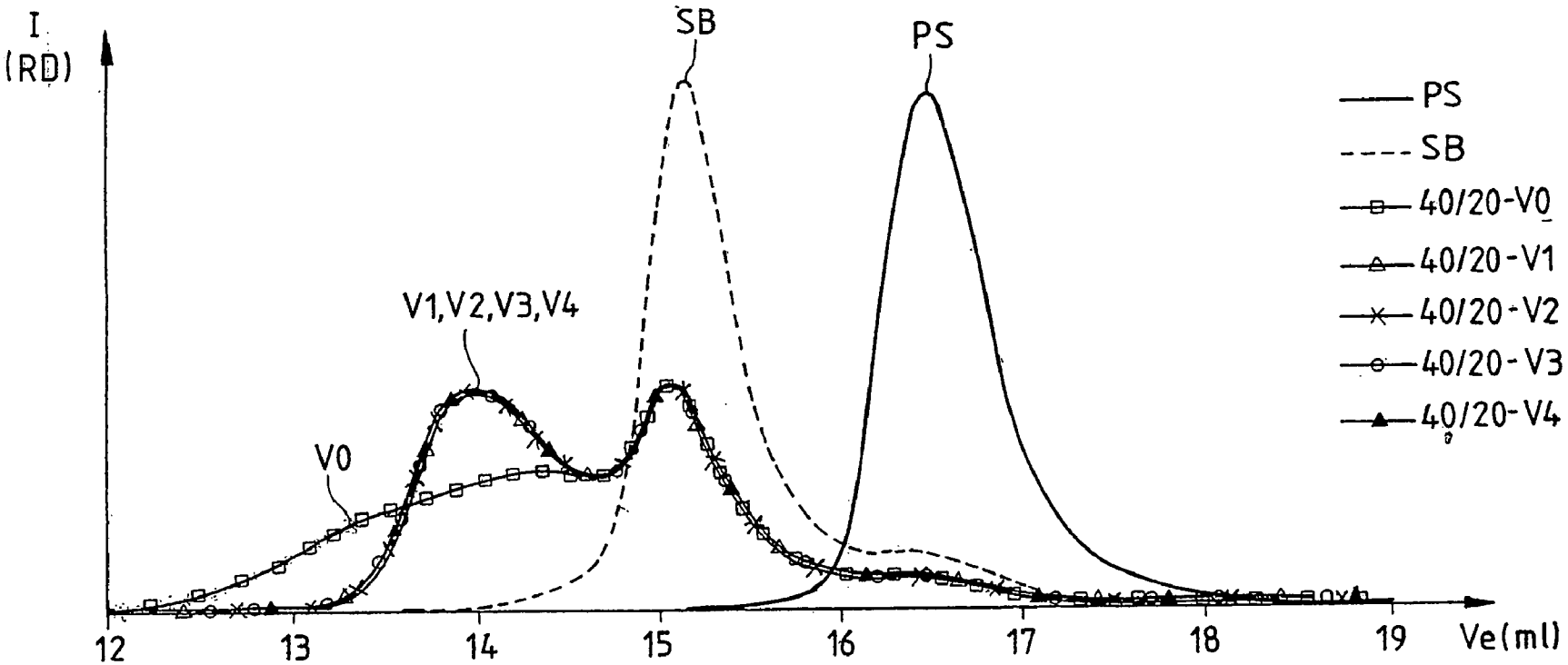

The results are shown in FIG. 7.

The same conclusions as in Example 1 are reached, namely:

- no notable difference is observed between the synthesized ABC 101 when passing from V1 to V4.;
- in all cases, the presence of residual SB in the product obtained is noted;
- the proportion of SB in the synthesized ABC 100 is significantly higher at V0 (static mixer) than for V1, V2, V3, or V4, which again shows that the dynamic micromixer according to the invention performs better than a static mixer.

Example 3

In this example, in a micromixer according to the invention, the influence of the total flow rate Q (SB)+Q(M), with a constant flow rate ratio Q(SB)/Q(M) and a constant speed of rotation of the rotor, on the quality of a synthesized ABC 100 triblock is studied.

In a first case, the sum of the flow rates Q(SB) and Q(M), respectively, 30 kg/h and 15 kg/h, is equal to 45 kg/h.

In a second case, the sum of the flow rates Q(SB) and Q(M), respectively, 40 kg/h and 20 kg/h, is equal to 60 kg/h.

Figure 8:
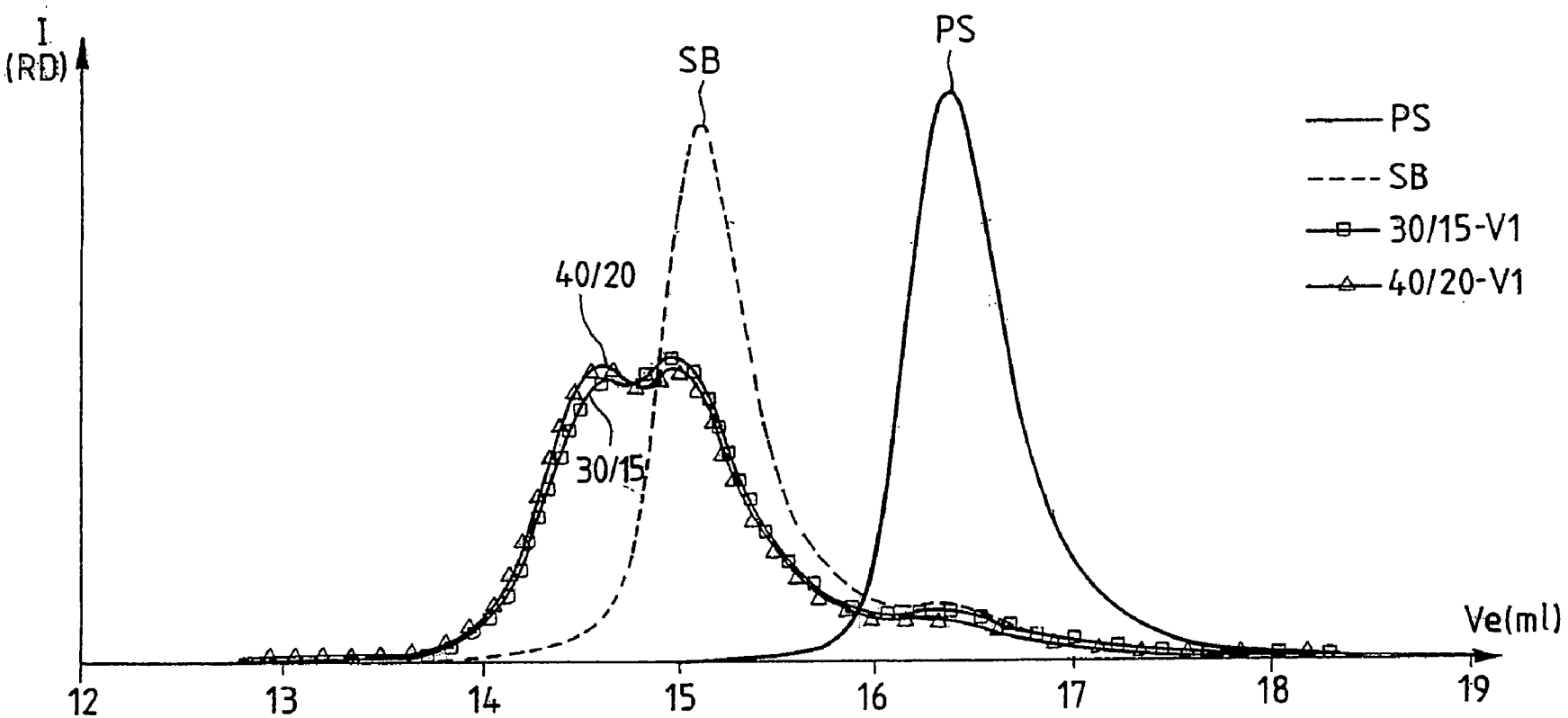
FIGS. 8 and 9 are curves showing the influence of the flow rates of the fluids on the quality of product obtained, at a constant speed of rotation of the rotor of the micromixer according to the invention.

The results are shown in FIG. 8.

It is noted that the increase in the total flow rate leads to better results.

Example 4

The same study as in Example 3 is undertaken, but synthesizing an ABC 101 triblock instead of the previous ABC 100 triblock.

Figure 9:
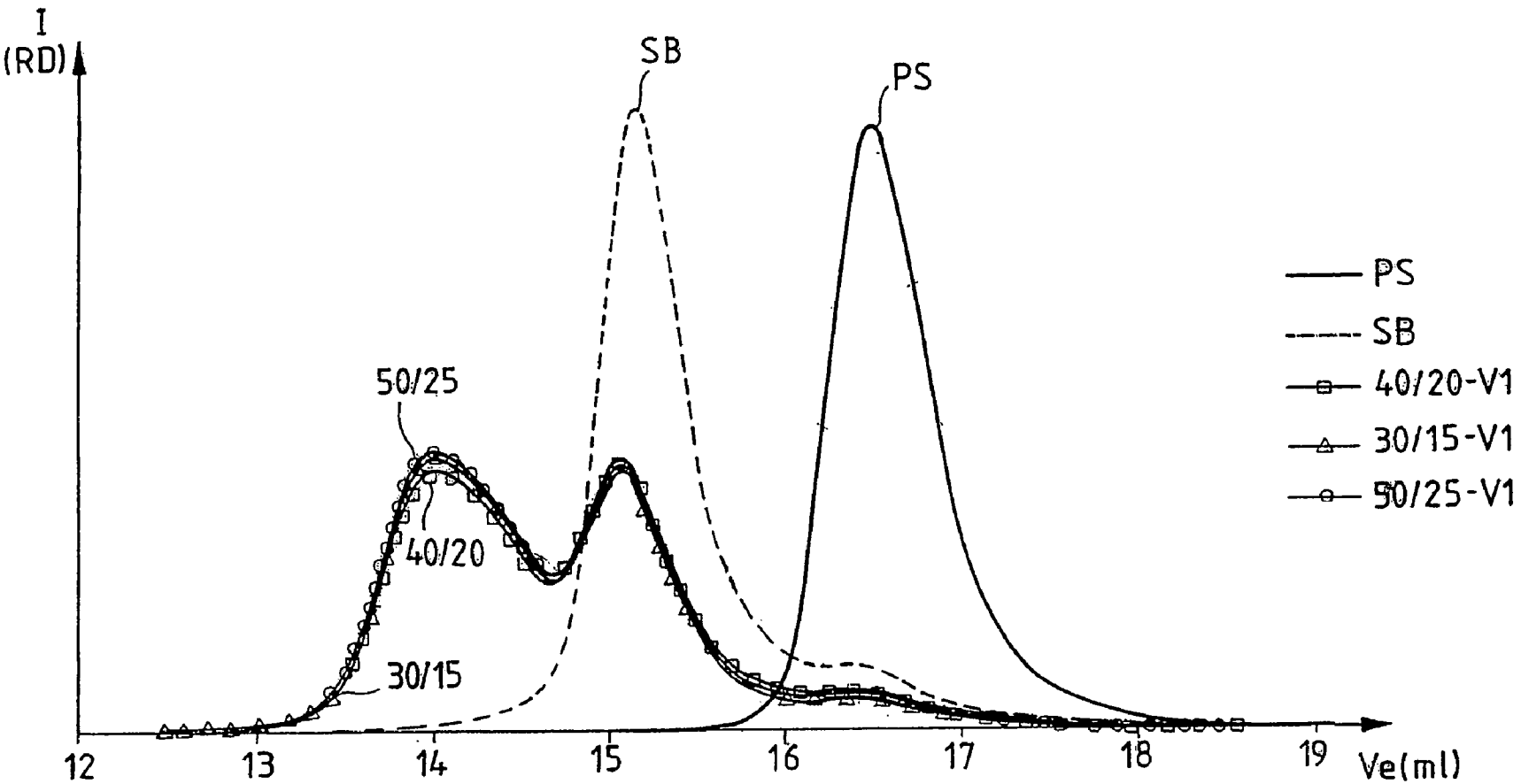

The results are shown in FIG. 9.

It is noted that for this product, ABC 101, the variation in the total flow rate has very little influence on the quality of the synthesized product, from the time when this flow rate has reached a minimum value which is sufficient to allow a characteristic micromixing time which is shorter than the reaction time.

Example 5

In this example, the results obtained with three types of mixers were compared, namely:

- a tangential jet mixer (114T);
- a static mixer (speed V0); and
- the mixer according to the invention (speed V2).

In the three cases, ABC 104 was synthesized with constant flow rates, Q(SB)=30 kg/h and Q(M)=15 kg/h.

Figure 10:
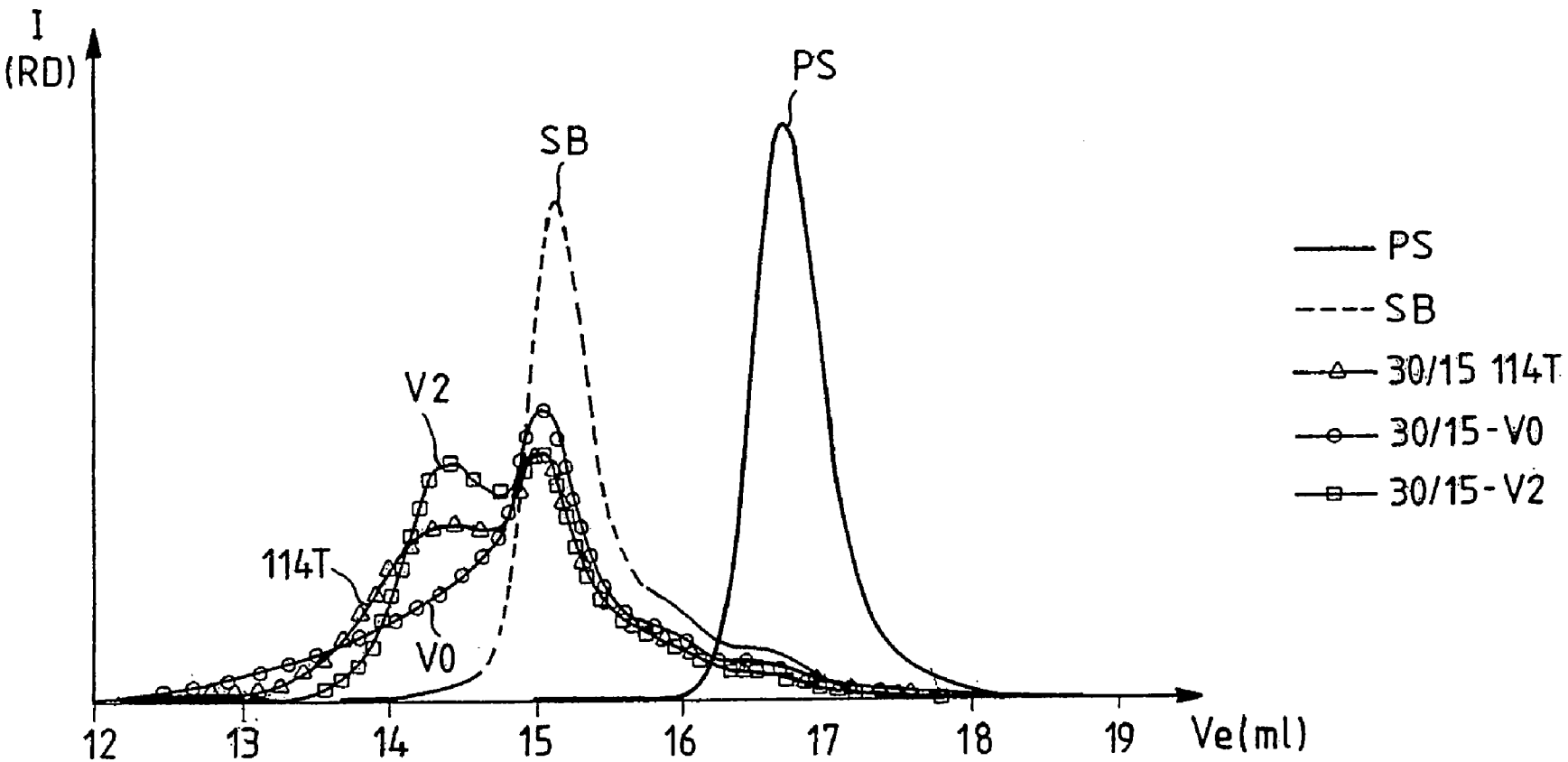
FIGS. 10 and 11 are curves showing the influence of the type of mixer used on the quality of product obtained, at constant flow rates.

The results are shown in FIG. 10.

The following is noted:

- on the one hand, a significant improvement in the rate of coupling (which results in a fall in the quantity of residual SB diblock in the SBM), when using a tangential jet or dynamic mixer rather than a static mixer, and
- on the other hand, a notable improvement in the quality of the coupling when passing from a tangential jet mixer to the mixer according to the invention.

These results are expressed by different dispersities of population of the different chains, i.e. by different polymolecularity indexes (Ip):

Ip=2.45 for the static mixer;

Ip=2.01 for the tangential jet mixer;

Ip=1.80 for the dynamic mixer according to the invention.

Example 6

In this example, the operation is carried out as in Example 5, except that higher total flow rates were used, namely, 60 kg/h instead of 45 kg/h.

Figure 11:
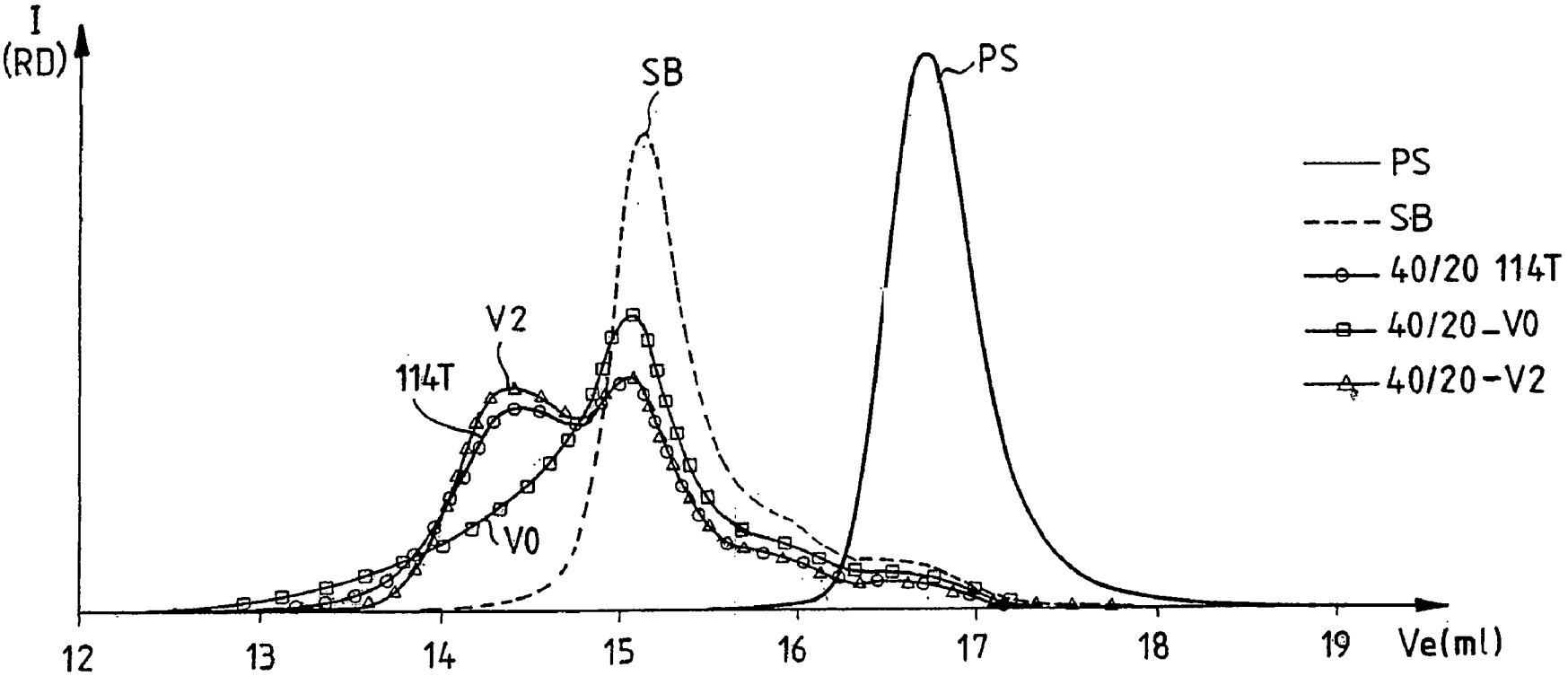

The results are shown in FIG. 11.

The same conclusions are reached as in Example 5.

A significant improvement in the Ip is also noted in the case of the static mixer. Specifically:

Ip=2.02 for the static mixer;

Ip=1.98 for the tangential jet mixer;

Ip=1.80 for the dynamic mixer according to the invention.

Nevertheless, the dynamic mixer according to the invention is clearly performs better than the tangential jet mixer and a fortiori than the static mixer.

The invention claimed is:

1. A method for continuously and dynamically mixing at least two fluids, comprising:

a) driving in rotation a rotor (1) of a micromixer comprising:

a rotor (1) comprising a shaft (2) equipped with blades (3) distributed in groups (3*a*-3*g*), the blades (3) of each group (3*a*-3*g*) being arranged around the shaft (2) in the same plane perpendicular to the longitudinal axis of the shaft (2), and the groups (3*a*-3*g*) of blades (3) being spaced out from each other along the longitudinal axis of the shaft (2);

a stator (4) in the form of a hollow cylinder which is able to receive the rotor (1), this stator (4) comprising, at one end of its longitudinal axis, at least one inlet (5) for a first fluid, at least one inlet (6) for a second fluid and, at the other end of its longitudinal axis, an outlet (7) for the micromixture of the fluids;

b) introducing the fluids into the micromixer; and c) recovering at the outlet (7) of the micromixer a micromixture of the fluids.

2. The method according to claim 1, wherein the rotor (1) is driven in rotation at a speed equal to at most 30,000 r.p.m.

3. The method according to claim 1, wherein the first and second fluids are introduced in at least two places (5, 6) diametrically opposed with respect to the axis of the rotor (1).

4. The method according to claim 1, at a fluid temperature of between -100° C. and 300° C.

5. The method according to claim 1, implemented with fluid pressures comprised between 0.1 and 100 bars-absolute.

6. The method according to claim 1, wherein the fluids are introduced into the mixer at a flow rate between 1 g/h and 10,000 kg/h.

7. The method according to claim 1, as a ratio of the mass flow rates comprised between 0.01 and 100.

8. The method according to claim 1, wherein the fluids have a viscosity comprised between 1 mPa.s and $10^3$ Pa.s.

9. The method according to claim 1, implemented with residence times of the fluids in the micromixer greater than 1 ms.

10. The method according to claim 1, wherein the fluids are reactive fluids.

11. The method according to claim 10, wherein the fluids are liquids which produce anionic polymerization reactions.

12. The method according to claim 11, wherein at least one of the fluids comprises at least one (meth)acrylic monomer.

13. The method according to claim 12, wherein the (meth)acrylic monomer is acrylic anhydride, methacrylic anhydride, methyl, ethyl, propyl, n-butyl, tert-butyl, ethylhexyl, nonyl, or 2-dimethyl amino ethyl acrylate or methyl, ethyl, propyl and n-butyl, tert-butyl, ethylhexyl, nonyl or 2-dimethyl amino ethyl methacrylate.

14. A polymerization method, comprising:

(i) driving in rotation the rotor (1) of a micromixer comprising:

a rotor (1) comprising a shaft (2) equipped with blades (3) distributed in groups (3*a*-3*g*), the blades (3) of each group (3*a*-3*g*) being arranged around the shaft (2) in the same plane perpendicular to the longitudinal axis of the shaft (2), and the groups (3*a*-3*g*) of blades (3) being spaced out from each other along the longitudinal axis of the shaft (2);

a stator (4) in the form of a hollow cylinder which is able to receive the rotor (1), this stator (4) comprising, at one end of its longitudinal axis, at least one inlet (5) for a first fluid, at least one inlet (6) for a second fluid and, at the other end of its longitudinal axis, an outlet (7) for the micromixture of the fluids;

(ii) introduction of at least two fluids, at least one of which is reactive, into the micromixer;

(iii) recovery at the outlet (7) of the micromixer of a micromixture of the fluids;

(iv) polymerization of the reactive fluid or fluids.

15. The polymerization method according to claim 14, in which at least one of the fluids comprises at least one (meth)acrylic monomer.

16. The polymerization method according to claim 15, wherein the (meth)acrylic monomer is acrylic anhydride, methacrylic anhydride, methyl, ethyl, propyl, n-butyl tert-butyl, ethylhexyl, nonyl, or 2-dimethyl amino ethyl acrylate or methyl, ethyl, propyl and n-butyl, tert-butyl, ethylhexyl, nonyl or 2-dimethyl amino ethyl methacrylate.

17. A micromixer comprising:

a rotor (1) comprising a shaft (2) equipped with blades (3) distributed in groups (3*a*-3*g*), the blades (3) of each group (3*a*-3*g*) being arranged around the shaft (2) in the same plane perpendicular to the longitudinal axis of the shaft (2), and the groups (3*a*-3*g*) of blades (3) being spaced out from each other along the longitudinal axis of the shaft (2); and a stator (4) approximately in the form of a hollow cylinder which is able to receive the rotor (1), this stator (4) comprising, at one end of its longitudinal axis, at least one inlet (5) for a first fluid, at least one inlet (6) for a second fluid and, at the other end of its longitudinal axis, an outlet (7) for the micromixture of the fluids.

18. The micromixer according to claim 17, wherein the stator (4) also comprises a plurality of disks (8), these disks (8) being stacked and arranged inside the stator (4), each disk having in its centre a recess (9) housing a group (3*a*-3*g*) of blades (3).

19. The micromixer according to claim 18, wherein the recess (9) of each disk (8) has the shape of a circular hole, one part of which is occupied by extensions of the disk (8) forming counter-blades (10).

20. The micromixer according to claim 19, wherein the counter-blades (10) of the disks (8) have the same shape and the same dimensions as the blades (3) of the rotor (1) and have a thickness less than that of the body (12) of the disk (8).

21. The micromixer according to claim 17, wherein the inlets (5, 6) of the stator are diametrically opposed.

22. The micromixer according to claim 17, further comprising a fluid distributor (17) in the form of a washer, this distributor (17) comprising at least one inlet for a first fluid and at least one inlet for a second fluid, these inlets communicating respectively with the inlets (5, 6) of the stator (4).

23. The method according to claim 1, wherein the rotor (1) is driven in rotation at a speed of greater than 5,000 and less than 20,000 r.p.m.

24. The method according to claim 1, at a fluid temperature of between −80° C. and 110° C.

25. The method according to claim 1, implemented with fluid pressures comprised between 1 and 50 bars.

26. The method according to claim 1, wherein the fluids are introduced into the mixer at a flow rate between 1 kg/h and 5,700 kg/h.

27. The method according to claim 1, at a ratio of the mass flow rates comprised between 0.1 and 10.

28. The method according to claim 1 wherein the fluids have a viscosity comprised between 10 mPa.s and 10 Pa.s.

29. The method according to claim 1 implemented with residence times of the fluids in the micromixer between 5ms and 10 s.

30. The method according to claim 14, wherein polymerization occurs outside the micromixer.

31. The method according to claim 14, wherein polymerization begins inside the micromixer and continues outside the micromixer.

* * * * *